US012152205B2

(12) United States Patent
Smith et al.

(10) Patent No.: US 12,152,205 B2
(45) Date of Patent: Nov. 26, 2024

(54) HYDROCARBON PYROLYSIS OF FEEDS CONTAINING SILICON

(71) Applicant: ExxonMobil Chemical Patents Inc., Baytown, TX (US)

(72) Inventors: Rodney S. Smith, Edinburgh (GB); Michael A. Radzicki, Houston, TX (US); Donald J. Norris, London (CA)

(73) Assignee: ExxonMobil Chemical Patents Inc., Baytown, TX (US)

( * ) Notice: Subject to any disclaimer, the term of this patent is extended or adjusted under 35 U.S.C. 154(b) by 195 days.

(21) Appl. No.: 17/904,849

(22) PCT Filed: Feb. 18, 2021

(86) PCT No.: PCT/US2021/018550

§ 371 (c)(1),
(2) Date: Aug. 23, 2022

(87) PCT Pub. No.: WO2021/202009

PCT Pub. Date: Oct. 7, 2021

(65) Prior Publication Data

US 2023/0105555 A1 Apr. 6, 2023

Related U.S. Application Data

(60) Provisional application No. 63/002,433, filed on Mar. 31, 2020.

(30) Foreign Application Priority Data

Jul. 6, 2020 (EP) ..... 20184304

(51) Int. Cl.
*C10G 69/06* (2006.01)
*C10G 65/02* (2006.01)

(52) U.S. Cl.
CPC ..... *C10G 69/06* (2013.01); *C10G 65/02* (2013.01); *C10G 2300/1033* (2013.01);
(Continued)

(58) Field of Classification Search
CPC ..... C10G 69/06; C10G 65/02; C10G 2300/1033; C10G 2300/202;
(Continued)

(56) References Cited

U.S. PATENT DOCUMENTS 5,679,241 A 10/1997 Stanley et al.
5,807,477 A 9/1998 Hearn et al.
(Continued)

FOREIGN PATENT DOCUMENTS

WO 2018/111574 A1 6/2018
WO 2020/096972 A1 5/2020
WO 2021/202009 A1 10/2021

OTHER PUBLICATIONS

Courtiade, Silicon speciation by gas chromatography coupled to mass spectrometry in gasolines, 2011, Journal of Chromatography A. 1218, 9269-9278 (Year: 2011).*
(Continued)

*Primary Examiner* — Randy Boyer
*Assistant Examiner* — Juan C Valencia

(57) ABSTRACT

Processes and systems for pyrolysing a hydrocarbon feed for a predetermined period of time, e.g., by steam cracking. The process can include determining a first amount of silicon material present in the hydrocarbon feed that is to be steam cracked to produce a steam cracker effluent. The process can also include determining a second amount of silicon material that will be present in a steam cracker naphtha that is to be separated from the steam cracker effluent.

26 Claims, 2 Drawing Sheets

(52) U.S. Cl.
CPC . *C10G 2300/202* (2013.01); *C10G 2300/301* (2013.01); *C10G 2400/20* (2013.01)

(58) Field of Classification Search
CPC ..... C10G 2300/301; C10G 2400/20; C10G 2400/02; C10G 45/32; C10G 9/36
See application file for complete search history.

(56) References Cited

U.S. PATENT DOCUMENTS

| | | | |
|---|---|---|---|
| 5,851,383 | A | 12/1998 | Frey |
| 6,419,885 | B1 | 7/2002 | Di et al. |
| 6,632,351 | B1 | 10/2003 | Ngan et al. |
| 7,090,765 | B2 | 8/2006 | Spicer et al. |
| 7,097,758 | B2 | 8/2006 | Stell et al. |
| 7,138,047 | B2 | 11/2006 | Stell et al. |
| 7,220,887 | B2 | 5/2007 | Stell et al. |
| 7,235,705 | B2 | 6/2007 | Stell |
| 7,244,871 | B2 | 7/2007 | Stell et al. |
| 7,247,765 | B2 | 7/2007 | Stell et al. |
| 7,297,833 | B2 | 11/2007 | Beattie et al. |
| 7,311,746 | B2 | 12/2007 | Stell et al. |
| 7,312,371 | B2 | 12/2007 | Stell et al. |
| 7,351,872 | B2 | 4/2008 | Stell et al. |
| 7,488,459 | B2 | 2/2009 | Stell et al. |
| 7,578,929 | B2 | 8/2009 | Stell et al. |
| 7,820,035 | B2 | 10/2010 | Mccoy et al. |
| 7,993,435 | B2 | 8/2011 | Stell et al. |
| 8,083,931 | B2 | 12/2011 | Mccoy et al. |
| 8,163,167 | B2 | 4/2012 | Himelfarb |
| 8,658,019 | B2 | 2/2014 | Bridges et al. |
| 8,696,888 | B2 | 4/2014 | Keusenkothen et al. |
| 8,894,844 | B2 | 11/2014 | Ross et al. |
| 9,090,836 | B2 | 7/2015 | Brown et al. |
| 9,327,260 | B2 | 5/2016 | Davis et al. |
| 9,637,694 | B2 | 5/2017 | Evans et al. |
| 9,657,239 | B2 | 5/2017 | Beech, Jr. et al. |
| 9,777,227 | B2 | 10/2017 | Soultanidis et al. |
| 2005/0173628 | A1* | 8/2005 | Ahern ..... H01J 49/107 250/288 |
| 2007/0090020 | A1* | 4/2007 | Buchanan ..... C10G 45/44 422/600 |
| 2007/0170098 | A1 | 7/2007 | Bouchy et al. |
| 2008/0194900 | A1 | 8/2008 | Bhirud |
| 2012/0125812 | A1 | 5/2012 | Bridges et al. |
| 2014/0061100 | A1 | 3/2014 | Lattner et al. |
| 2014/0357923 | A1 | 12/2014 | Pavia et al. |
| 2016/0376511 | A1 | 12/2016 | Srivastava et al. |
| 2018/0170832 | A1 | 6/2018 | Janda et al. |

OTHER PUBLICATIONS

Extended European Search Report received for European Patent Application No. 20184304.2, mailed on Dec. 11, 2020, 11 Pages.

Chainet, F. et al., (2013) "Characterization of silicon species issued from PDMS degradation under thermal cracking of hydrocarbons: Part 1—Gas samples analysis by gas chromatography-time of flight mass spectrum", Fuel, vol. 111, pp. 519-527.

Chainet, F. et al., (2011) "Silicon speciation by gas chromatography coupled to mass spectrometry in gasolines", Journal of chromatography A , vol. 1218, No. 51, pp. 9269-9278.

International Preliminary Report on Patentability received for PCT Application No. PCT/US2021/018550, mailed on Oct. 13, 2022, 12 Pages.

International Search Report and Written Opinion received for PCT Application No. PCT/US2021/018550, mailed on May 27, 2021, 15 Pages.

* cited by examiner

HYDROCARBON PYROLYSIS OF FEEDS CONTAINING SILICON

CROSS-REFERENCE TO RELATED APPLICATIONS

This application is a US national phase application of PCT Application Serial No. PCT/US2021/018550 having a filing date of Feb. 18, 2021, which claims priority to and the benefit of U.S. Provisional Application No. 63/002,433 having a filing date of Mar. 31, 2020 and European Patent Application No. 20184304.2 having a filing date of Jul. 6, 2020, the disclosures of all of which are incorporated herein by reference in their entireties.

FIELD

Embodiments disclosed herein generally relate to pyrolysis processes for $C_{5+}$ hydrocarbon conversion, e.g., conversion of heavy oil, such as crude oil. More particularly, such processes relate to pyrolysis processes and systems for pyrolysing a hydrocarbon feed that includes one or more forms of silicon.

BACKGROUND

Pyrolysis processes, e.g., steam cracking, convert relatively low-value hydrocarbon-containing feeds to higher value products such as ethylene and propylene. Besides these, the pyrolysis can produce naphtha, gas oil, and a significant amount of relatively low-value heavy products such as pyrolysis tar.

When a steam cracker operates in pyrolysis mode, a hydrocarbon feed is preheated and combined with steam in tubular convections coils located in a convection section of a steam cracking furnace. The feed-steam mixture, or a vapor-phase portion thereof, is pyrolysed in tubular radiant coils located in a radiant section of the steam cracking furnace. During pyrolysis mode operation, separations equipment located downstream of the steam cracking furnace is typically used to separate the various products, such as a process gas, steam cracker naphtha (SCN), steam cracker gas oil (SCGO), steam cracker quench oil (SCQO), steam cracker tar (SCT), etc., from the steam cracker effluent. Since coke accumulates in locations within the steam cracking furnace, the furnace is typically switched from pyrolysis mode to decoking mode for removing coke, e.g., from the radiant coils. During decoking mode, the flow of hydrocarbon feed to the steam cracking furnace is decreases or halted, and a flow of decoking fluid is established instead. Decoking fluid typically contains one or more of steam, water, and air. In on-stream decoking, the decoking fluid contains little or no air, and a portion of the radiant coils remain in pyrolysis mode, while another portion of the radiant coils operate in decoking mode.

As technology for pyrolysing primarily liquid-phase hydrocarbon feeds improves, there is increased interest in utilizing heavier liquid-phase feeds, e.g., those primarily liquid-phase hydrocarbon feedstocks having an API gravity less than that of naphtha ("relatively-heavy primarily liquid-phase hydrocarbon feeds", also called "advantaged feeds"). Although advantaged feeds can include those that have been subjected to prior processing, such as certain gas oils, advantaged feeds also can include raw feeds such as crude oils, e.g., crude oils comprising medium hydrocarbon and/or heavy hydrocarbon. For example, utilizing advantaged feeds comprising raw feedstocks, e.g., various crude oils, would increase the supply of available liquid feeds, and would decrease the steam cracker plant's dependence on refinery process streams to satisfy steam cracker feed needs. This in turn would improve a steam cracker facility's economics, e.g., by decreasing light olefin production costs, and by making relatively high-value refinery streams available for other purposes.

Although relatively heavy hydrocarbon feeds have become an attractive option, e.g., from a cost standpoint, such feeds can introduce significant levels of contaminants, such as various forms of silicon-containing compositions, into the pyrolysis process that typically have not been a concern in conventional pyrolysis processes that utilize higher value feedstocks, e.g., $C_2$-$C_4$ hydrocarbons. The presence of silicon-containing material can interfere with the pyrolysis process, and in particular can interfere with the separation, recovery, and upgrading of certain pyrolysis products. This in turn can lead to a shortened operating period of uncertain duration, after which equipment and materials utilized in the process need repair, regeneration, or other restoration activity before the pyrolysis process can be returned to operation.

There is a need, therefore, for improved pyrolysis processes, e.g., steam cracking, for pyrolysing a hydrocarbon feed that includes one or more silicon-containing contaminants. There is a particular need for processes and systems capable of pyrolysing a hydrocarbon feed containing one or more forms of silicon-containing compositions and recovering desired products from the pyrolysis effluent for a predetermined period of time.

SUMMARY

The invention is based in part on the discovery that pyrolysis converts at least a portion of certain forms of silicon present in a hydrocarbon feed, e.g., elemental silicon and/or silica, to other forms of silicon-containing compositions, e.g., silicones that appear in the pyrolysis effluent. In addition to the silicones resulting from the conversion, it has been found that unconverted silicones can also appear in the pyrolysis effluent, e.g., silicones that are present in the hydrocarbon feed and are carried through the pyrolysis. It has been observed that the presence of certain forms of silicon, e.g., silicones produced by or carried through the pyrolysis, can lead to difficulties processing the pyrolysis effluent. More particularly, it has been found that certain forms of silicon, e.g., silicones, having an atmospheric boiling point in the naphtha boiling-range can deactivate catalyst used for hydroprocessing the naphtha boiling range fraction of the pyrolyse effluent, resulting in shortened run length of the hydroprocessing reactor. This in turn limits the duration of the time period in which the pyrolysis can be operate. After the hydroprocessing catalyst has been replaced, regenerated, rejuvenated, or otherwise restored, the pyrolysis can be returned to operation.

Accordingly, certain aspects of the invention relate to processes, methods, apparatus, and systems for pyrolysing for a predetermined period of time a hydrocarbon feed containing one or more forms of silicon-containing compositions. In these and other aspects, the types and amounts of various silicon-containing compositions in the hydrocarbon feed ("feed compositional information") can be determined. It is observed for a wide variety of hydrocarbon feeds that the hydrocarbon feed's compositional information can be used to determine the types and amounts of silicon-containing compositions that are produced by or carried through the pyrolysis to the naphtha boiling-range fraction of the pyrolyse effluent ("naphtha compositional information"). The naphtha compositional information can be used to preselect an amount of hydroprocessing catalyst such that for a predetermined period of time the hydroprocessing of the naphtha fraction of the pyrolysis effluent can be carried out without a need to replace, regenerate, and/or rejuvenate the catalyst, or otherwise restore the catalyst's activity (collectively, "replacement or re-activation").

In aspects where the pyrolysis includes steam cracking, a hydrocarbon feed and an aqueous composition comprising water, steam, or a mixture of water and steam can be mixed and heated (in any order) to produce a steam cracking feed. A vapor phase product and a liquid phase product can be separated from the steam cracking feed. The vapor phase product (referred to here as a pyrolysis feed) can be steam cracked to produce a steam cracker effluent. A steam cracker naphtha and a process gas that can include ethylene and propylene can be separated from the steam cracker effluent. The steam cracker naphtha can be hydroprocessed for at least as long as the predetermined period of time.

The steam cracking can include measuring a first amount of silicon in a hydrocarbon feed. The first amount of silicon is equal to the total mass of silicon that is present in all silicon forms in a given mass of hydrocarbon feed. A second amount of silicon that will be present in a steam cracker naphtha that is to be separated from the steam cracker effluent can be determined based, at least in part, on the first amount of silicon. The second amount of silicon is equal to the total mass of silicon that is present in all forms of silicon in a given amount of steam cracker naphtha. A sufficient amount of at least one catalyst can be introduced into a hydroprocessing unit to allow the hydroprocessing unit to hydroprocess the steam cracker naphtha that is to be separated from the steam cracker effluent for at least as long as a predetermined period of time without requiring replacement or re-activation of an at least partially-deactivated catalyst, wherein the deactivation results from the second amount of silicon in the steam cracker naphtha.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
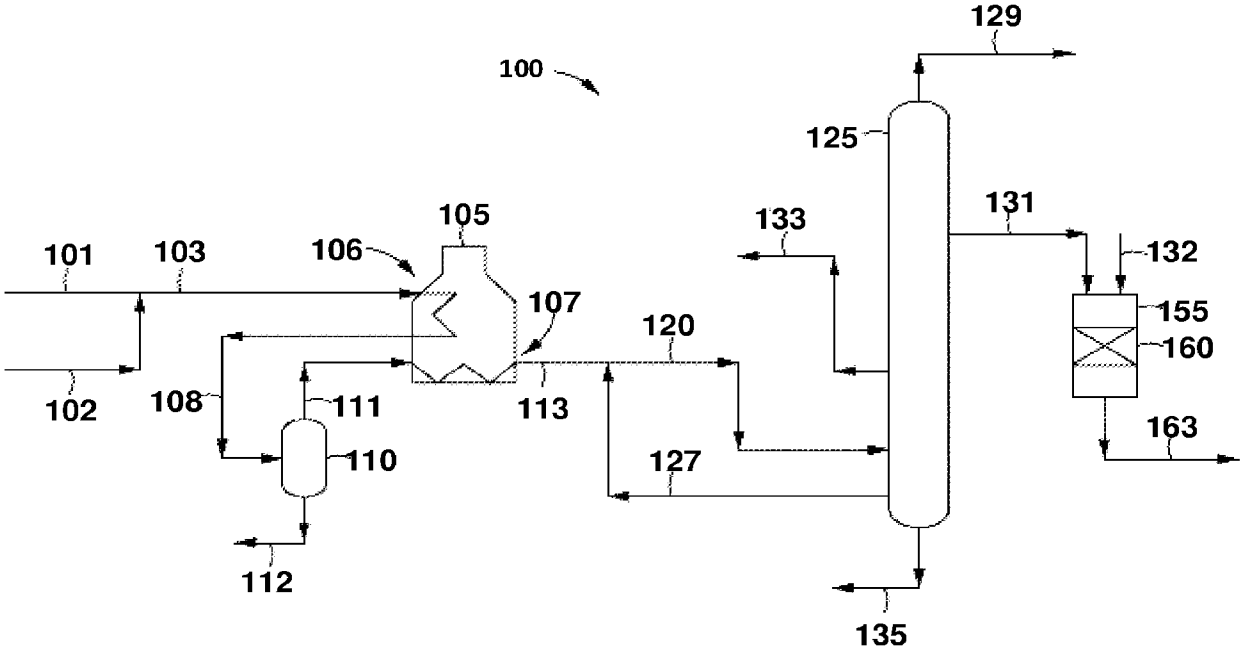
FIG. 1 depicts a schematic of an illustrative system for steam cracking a hydrocarbon feed, separating products therefrom including steam cracker naphtha, and hydroprocessing the steam cracker naphtha for at least as long as a predetermined period of time, according to one or more embodiments.

It is to be understood that the following disclosure describes several exemplary embodiments for implementing different features, structures, and/or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the exemplary embodiments presented below can be combined in any combination of ways, i.e., any element from one exemplary embodiment can be used in any other exemplary embodiment, without departing from the scope of the disclosure. For the purpose of this description and appended claims, the following terms are defined.

"Hydrocarbon" means a class of compounds containing hydrogen bound to carbon. The term "$C_n$" hydrocarbon means hydrocarbon having n carbon atom(s) per molecule, where n is a positive integer. The term "$C_{n+}$" hydrocarbon means hydrocarbon having at least n carbon atom(s) per molecule, where n is a positive integer. The term "$C_{n-}$" hydrocarbon means hydrocarbon having no more than n number of carbon atom(s) per molecule, where n is a positive integer. "Hydrocarbon" encompasses (i) saturated hydrocarbon, (ii) unsaturated hydrocarbon, and (iii) mixtures of hydrocarbons, including mixtures of hydrocarbon compounds (saturated and/or unsaturated), including mixtures of hydrocarbon compounds having different values of n.

"Heavy hydrocarbon" means a mixture comprising hydrocarbon, the mixture having an API gravity in the range of from 5° up to (but not including) 22°. "Medium hydrocarbon" means a mixture comprising hydrocarbon, the mixture having an API gravity in the range of from 22° to 30°. A "relatively-heavy" hydrocarbon has an API gravity that is less than that of naphtha.

The term "unsaturate" or "unsaturated hydrocarbon" means a $C_{2+}$ hydrocarbon containing at least one carbon atom directly bound to another carbon atom by a double or triple bond. The term "olefin" means an unsaturated hydrocarbon containing at least one carbon atom directly bound to another carbon atom by a double bond. In other words, an olefin is a compound which contains at least one pair of carbon atoms, where the first and second carbon atoms of the pair are directly linked by a double bond. "Light olefin" means $C_{5-}$ olefinic hydrocarbon.

"Primarily liquid phase" means a composition of which ≥50 wt. % is in the liquid phase, e.g., ≥75 wt. %, such as ≥90 wt. %. A hydrocarbon feedstock is a primarily liquid-phase hydrocarbon feedstock when ≥50 wt. % of the hydrocarbon feedstock is in the liquid phase at a temperature of 25° C. and a pressure of 1 bar absolute, e.g., ≥75 wt. %, such as ≥90 wt. %.

"Raw" feedstock, e.g., raw hydrocarbon feedstock, means a primarily liquid-phase feedstock that comprises ≥25 wt. % of crude oil that has not been subjected to prior desalting and/or prior fractionation with reflux, e.g., ≥50 wt. %, such as ≥75 wt. %, or ≥90 wt. %.

"Crude oil" means a mixture comprising naturally-occurring hydrocarbon of geological origin, where the mixture (i) comprises ≥1 wt. % of resid, e.g., ≥5 wt. %, such as ≥10 wt. %, and (ii) has an API gravity ≤52°, e.g., ≤30°, such as ≤20°, or ≤10°, or <8°. The crude oil can be classified by API gravity, e.g., heavy crude oil has an API gravity in the range of from 5° up to (but not including) 22°.

Normal (or "atmospheric") boiling point and normal boiling point ranges can be measured by gas chromatograph distillation according to the methods described in ASTM D-6352-98 or D2887, as extended by extrapolation for materials above 700° C.

A hydrocarbon feed, e.g., a $C_{5+}$ hydrocarbon, such as one that is primarily in the liquid phase at a temperature of 25° C. and a pressure of 1 bar (absolute), can be mixed, blended, combined, or otherwise contacted with an aqueous composition comprising water, steam, or a mixture thereof to produce a steam cracking feed. The hydrocarbon feed can be heated before and/or after it is combined with the aqueous composition. A primarily vapor phase pyrolysis feed and a liquid phase product can be separated from the steam cracking feed. The pyrolysis feed can be heated and subjected to steam cracking conditions to produce a steam cracker effluent. The steam cracker effluent can be cooled to produce a cooled steam cracker effluent. For example, the steam cracker effluent can be directly contacted with a quench fluid and/or indirectly cooled via one or more heat exchangers, e.g., a transfer line exchanger ("TLE"), to produce a cooled steam cracker effluent. One of the products that can be separated from the cooled steam cracker effluent can be steam cracker naphtha. Steam cracker naphtha is a complex mixture of $C_{5+}$ hydrocarbons, e.g., $C_5$-$C_{10+}$ hydrocarbons, having an initial atmospheric boiling point of about 25° C. to about 50° C. and a final boiling point of about 220° C. to about 265° C., as measured according to ASTM D2887-18. In some examples, the steam cracker naphtha can have an initial atmospheric boiling point of about 33° C. to about 43° C. and a final atmospheric boiling point of about 234° C. to about 244° C., as measured by ASTM D2887-18. The hydrocarbon feed contains one or more forms of silicon, e.g., silicon material.

"Silicon material" means a composition comprising silicon, such as a composition comprising one or more of elemental silicon, silicon oxides (including silica). The term silicon material encompasses natural and synthetic forms of silicon, e.g., silicon material can be one or more of aggregates, mixtures, ores, compounds, complexes, etc.

The steam cracker naphtha can be hydroprocessed to produce a stabilized or hydroprocessed steam cracker naphtha product. For example, the steam cracker naphtha can be hydroprocessed in the presence of molecular hydrogen and one or more catalysts to produce the hydroprocessed steam cracker naphtha, which can also be referred to as stabilized steam cracker naphtha. Hydroprocessing the steam cracker naphtha can hydrogenate at least a portion of any diolefins to monoolefins present in the steam cracker naphtha and/or convert at least a portion of any olefins to paraffins, and/or convert at least a portion of any sulfur compounds to hydrogen sulfide that can be present in the steam cracker naphtha. In some examples, a motor gasoline ("mogas") blendstock can be produced. Mogas blendstock is a mixture that includes $C_4$-$C_{12}$ hydrocarbons having an initial atmospheric boiling point of about 35° C. and a final boiling point of about 200° C. The mogas blendstock can include the stabilized steam cracker naphtha.

It has been surprisingly and unexpectedly discovered that when the hydrocarbon feed contains silicon material, hydroprocessing the steam cracker naphtha to produce the hydroprocessed steam cracker naphtha can be the limiting factor with regard to how long of a period of time the steam cracking process can be operated before a shutdown or turndown of the steam cracker is needed. More particularly, it has been discovered that the one or more catalysts used in the hydroprocessing of steam cracker naphtha can become deactivated, degraded, poisoned, or otherwise rendered insufficiently effective (collectively, "deactivated") before another processing unit is rendered ineffective for carrying out its processing function. It has been found that the deactivation mainly results from the silicon material in the hydrocarbon feed subjected to steam cracking and from silicon material derived from the silicon material in the hydrocarbon feed. The silicon material contained in the naphtha deactivates the catalyst(s) used in the hydroprocessing of the steam cracker naphtha.

Accordingly, a process and system for steam cracking a hydrocarbon feed containing high levels of silicon material, e.g., 0.05 weight part per million or "wppm" to about 50 wppm of silicon material or about 0.1 wppm to about 25 wppm of silicon material, can be configured to run for a predetermined period of time before requiring a shutdown or turndown resulting from catalyst deactivation.

The predetermined period of time the steam cracking process can be configured to run for can be any desired length of time, so long as the hydroprocessing reactor has sufficient capacity for the predetermined amount of hydroprocessing catalyst(s). In some examples, the predetermined period of time can be about 1 day, about 2 days, or about 3 days to about 1 month, about 6 months, about 1 year, about 1.5 years, about 2 years, about 3 years, or about 4 years. In some examples, the predetermined period of time can be based, at least in part, on a desired volume of the hydrocarbon feed that that is conducted to the steam cracker for steam cracking during the predetermined period of time.

The process for upgrading or steam cracking the hydrocarbon feed for a predetermined period of time can include estimating, measuring, or otherwise determining the first amount of silicon, i.e., the amount of silicon present in its various forms in the hydrocarbon feed (e.g., the total mass in grams of all forms of silicon present in a given mass of the hydrocarbon feed). The amount of silicon material (and/or the amount of silicon in the silicon material) in the hydrocarbon feed can be measured or otherwise determined using any suitable technique. In some examples, a representative sample of the hydrocarbon feed can be analyzed via an atomic emission detector, an x-ray fluorescence (XRF) spectrometer, an inductively coupled plasma-mass spectrometer (ICP-MS), inductively coupled plasma-atomic emission spectroscopy (ICP-AES), or a combination thereof to measure the amount of silicon material therein. The amount of silicon material can be measured via inductively coupled plasma-mass spectrometer according to UOP1006-14, Trace Silicon in Petroleum Liquids by ICP-MS, ASTM International, West Conshohocken, PA, 2014. The amount of silicon material can be measured via inductively coupled plasma-atomic emission spectroscopy according to ASTM D5708-15. In some examples, amount of silicon material can be measured via inductively coupled plasma-mass spectrometry according to ASTM D8110-17.

In certain aspects, the hydrocarbon feed comprises (i) silicon material and (ii) a heavy and/or medium hydrocarbon. These aspects will now be described in more detail. The invention is not limited to these aspects, and this description is not meant to exclude other aspects within the broader scope of the invention, such as those in which the hydrocarbon feed is a medium and/or light hydrocarbon.

Hydrocarbon Feed

In certain aspects, the hydrocarbon feed comprises hydrocarbon and silicon material. Those skilled in the art will appreciate that the term "hydrocarbon feed" is a convenient label, but does not mean that the feed contains hydrocarbon only. Although at least a portion of the hydrocarbon feed's silicon material can be added to the hydrocarbon feed, it is typical for most or even all of the silicon material to be present in the feed at the feed's source. For example, the silicon material in the hydrocarbon feed can be silicon material that is naturally present in certain heavy hydrocarbons, such as silicon material that is naturally present in crude oil. In these and other aspects, the hydrocarbon can have a nominal final boiling point of about 315° C. or greater, such as about 400° C. or greater, about 450° C. or greater, or about 500° C. or greater.

In certain aspects, the feed's hydrocarbon can be relatively-high molecular weight hydrocarbon, e.g., a heavy hydrocarbon, such as those which pyrolyse to produce a relatively large amount of steam cracker naphtha (also called pyrolysis gasoline), steam cracker gas oil ("SCGO"), and SCT during steam cracking. The heavy hydrocarbon may include one or more of resids (also called residual oil or residues), gas oils, heating oil, jet fuel, diesel, kerosene, coker naphtha, hydrocrackate, reformate, raffinate reformate, distillate, crude oil, atmospheric pipestill bottoms, vacuum pipestill streams including bottoms, condensates, heavy non-virgin hydrocarbon streams from refineries, vacuum gas oils, heavy gas oil, naphtha contaminated with crude, atmospheric residue, heavy residue, $C_4$/residue admixture, naphtha residue admixture, gas oil residue admixture, low sulfur waxy residue, atmospheric residue, and heavy residue.

In certain aspects, the hydrocarbon feed includes economically-advantaged, minimally-processed heavy hydrocarbon containing non-volatile components and coke precursors. For example, the hydrocarbon feed can include about 1 wt. % or more of heavy hydrocarbon, based on the weight of the hydrocarbon feed, such as about 25 wt. % or more, about 50 wt. % or more, about 75 wt. % or more, about 90 wt. % or more, or about 99 wt. % or more. The hydrocarbon feed can comprise, consist of, or consist essentially of one or more raw feeds, such as one or more crude oils.

In certain aspects, the hydrocarbon feed further comprises relatively-low molecular weight hydrocarbon (e.g., medium and/or light hydrocarbon). Light hydrocarbon typically includes naphtha boiling-range hydrocarbon and substantially saturated hydrocarbon molecules having fewer than five carbon atoms, e.g., ethane, propane, and mixtures thereof. Although hydrocarbon feedstocks comprising light hydrocarbon typically produce a greater yield of $C_2$ unsaturates than do those comprising heavy hydrocarbon, heavy hydrocarbon is of increasing interest due to lower costs and higher availability.

In these and other aspects, the silicon material (natural and/or synthetic) may be present in the hydrocarbon feed. For example, the hydrocarbon feed can include one or more of silicon, silicon-containing compounds, and compositions comprising silicon and/or silicon-containing compounds. Such silicon-containing compounds include inorganic silicon compounds and/or organosilicon compounds. Illustrative inorganic silicon compounds can be or include, but are not limited to silica, one or more silicates, or any mixture thereof. Illustrative organosilicon compounds can be or include, but are not limited to, silicones also referred to as polysiloxanes. In some examples, the polysiloxane can be or include, but are not limited to, polymethylsiloxanes having the chemical formula of $CH_3[SiO]_nCH_3$, one or more polydimethylsiloxanes having the chemical formula of $(CH_3)_3SiO[(CH_3)_2SiO]_nSi(CH_3)_3$, or a mixture thereof. Natural and/or synthetic silicon material as may be found in the hydrocarbon feed can be or include one or be included in one or more of sand; clay; other earthen and/or mineral forms of silicon-containing compositions (e.g., earthen aggregates, such as rocks, stone, dirt, etc.); quartz; glass; lava; soapstone, and pumice.

In certain aspects, the hydrocarbon feed contains silicon included in natural and/or synthetic minerals, such as one or more forms of silicate and/or non-silicate minerals, including compositions containing natural and/or synthetic silicon-bearing minerals. For example, the hydrocarbon feed can contain natural and/or synthetic silicates, such as one or more of neosilicates, sorosilicates, cyclosilicates, inosilicates (single and multiple-chain), phyllosilicates, tectosilicates (including those with and without zeolitic $H_2O$), and silicon-substituted germanites. Alternatively or in addition, the hydrocarbon feed can contain silicon in the form of natural and/or synthetic non-silicate minerals. Typical silicon-containing, non-silicate minerals include one or more of those metals, alloys, carbides, silicides, nitrides, and/or phosphides that contain silicon in any form, such as silicon carbide; one or more of those halogenides, oxyhalides, and hydroxyhalides that contain silicon in any form, such as chukhrovites; one or more of those oxides and hydroxides, vanadates, arsenites, antimonites, bismuthites, sulfites, and iodates that contain silicon in any form, e.g., one or more silicon-containing spinels, such as tegengrenite; one or more of those carbonates and nitrates that contain silicon in any form, such as tundrites; one or more of those sulfates, selenates, chromates, molybdates, wolframates, niobates that contain silicon in any form, such as dugganite; one or more of those phosphates, arsenates, polyvanadates that contain silicon in any form, such as palenzonaite ($(Ca,Na)_3Mn^{2+}(V^{5+},As^{5+},Si)_3O_{12}$); amorphous silicon-containing minerals; and organic silicon-containing minerals.

At least a portion of the silicon (in all forms) in the hydrocarbon feed is present in the pyrolysis feed. For example, ≥10 wt. %, of silicon (in all its forms) that is present in the hydrocarbon feed (based on the weight of the feed) is typically present in the pyrolysis feed, such as ≥25 wt. %, or ≥50 wt. %, or ≥75 wt. %, or ≥90 wt. %, or in a range of from 5 wt. % to 95 wt. %, or from 10 wt. % to 90 wt. %. Since there is generally little if any conversion of one form or silicon to another in the steam cracking furnace at locations upstream of the radiant coils, ≥10 wt. %, of silicon material that is present in the hydrocarbon feed (based on the weight of the feed) is typically present in the pyrolysis feed, such as ≥25 wt. %, or ≥50 wt. %, or ≥75 wt. %, or ≥90 wt. %, or in a range of from 5 wt. % to 95 wt. %, or from 10 wt. % to 90 wt. %. As will be appreciated by those skilled in the art, the amount of silicon material in the hydrocarbon feed that appears in the pyrolysis feed will depend, e.g., on whether a vapor-liquid separator is used to separate the pyrolysis feed from the steam cracking feed, and if so, the cut point established for the vapor-liquid separator.

Steam cracking the pyrolysis feed under steam cracking process conditions typically results in a conversion of at least a portion of certain forms of silicon in the pyrolysis feed to other forms of silicon. For example, e.g., the steam cracking can result in a conversion of at least a portion any polysiloxanes in the hydrocarbon feed and/or the pyrolysis feed, to other forms of silicon silicones of lesser molecular weight, e.g., linear and/or cyclic polysiloxanes. Although the amounts of each of the various forms of silicon may increase or decrease as a result of the steam cracking, the total mass of silicon (in all forms) in the steam cracker effluent, typically is substantially the same as the total mass of silicon (in all forms) in the pyrolysis feed. As such, the silicon material that in the steam cracker naphtha can correspond to silicon material present in the hydrocarbon feed before steam cracking and/or silicon material produced during steam cracking of the hydrocarbon. It will be appreciated by those skilled in the art, that certain forms of steam cracker furnace equipment, e.g., steam cracker tubes, such as certain forms of radiant coils, contain silicon material that may be transferred in small amounts to the steam cracker effluent during pyrolysis mode and on-stream decoking mode. Typically, however, the amount of such transferred silicon material in the steam cracker effluent is ≤1 wt. %, based on the weight of the steam cracker effluent, e.g., ≤0.1 wt. %, or ≤0.01 wt. %, such as in a range of from 0.01 wt. % to 1 wt. %.

Since the amount of silicon material in the steam cracker effluent from other sources has been found to be small, the amount of silicon (in all forms) that can be in the steam cracker naphtha fraction of the steam cracker effluent can be calculated or otherwise determined from the amount of silicon (in all forms) in the hydrocarbon feed. For example, the amount of silicon in the steam cracker effluent can be determined with an accuracy of 1% or better (on a weight basis) by multiplying the mass of silicon (as found in all its forms) in the hydrocarbon feed by the mass of the hydrocarbon feed. During pyrolysis mode, a first portion of the hydrocarbon feed's silicon material can be removed from the process by a vapor-liquid separation that is integrated with the convection section of the steam cracking furnace. The vapor-liquid separation, when used, includes separating at least two streams from the steam cracking feed: (i) a first stream comprising a primarily vapor phase portion of the steam cracking feed and (ii) a second stream comprising a primarily liquid phase portion of the steam cracking feed. In some examples, about 25% (weight basis) of the silicon material in the hydrocarbon feed is transferred to the second stream, e.g., about 30%, such as about 35%, or about 40% to about 55%, or about 60%, or about 65%, about 70%, or about 75%. As such, in some examples, about 25% (weight basis) of the silicon material in the hydrocarbon feed is transferred to the first stream, e.g., about 30%, such as about 35%, or about 40% to about 55%, or about 60%, or about 65%, or about 70%, or about 75%. After optional additional heating, e.g., in the convection section of the steam cracking furnace, the first stream can be introduced as pyrolysis feed into one or more of the steam cracking furnace's radiant coils.

In addition to steam cracker naphtha, a plurality of products can be separated from the cooled steam cracker effluent. Illustrative products that can be separated from the cooled steam cracker effluent can be or include, but are not limited to, a process gas that includes ethylene and propylene, a steam cracker gas oil, a steam cracker quench oil, and steam cracker tar or tar product. Similar to steam cracker naphtha, steam cracker gas oil and steam cracker quench oil each include a mixture of compounds, primarily a mixture of hydrocarbon compounds. In some examples, at least a portion of the steam cracker quench oil can be mixed, blended, combined, or otherwise contacted with the steam cracker effluent to produce the cooled steam cracker effluent. It should be understood that typically there is an overlap between steam cracker naphtha and steam cracker gas oil in composition and boiling point range. The final atmospheric boiling point of steam cracker gas oil is typically about 275° C. to about 285° C., as measured according to ASTM D2887-18. It should also be understood that typically there is an overlap between steam cracker gas oil and steam cracker quench oil in composition and boiling point range. The final atmospheric boiling point of steam cracker quench oil is typically about 455° C. to about 475° C., as measured according to ASTM D2887-18. The steam cracker tar can have a final atmospheric boiling point of>650° C.

During the process of separating products from the cooled steam cracker effluent, a first portion of the steam cracker effluent's silicon material can be removed from the process as a component of the steam cracker naphtha, a second portion of the silicon material can be removed from the process as a component of the steam cracker gas oil, and a third portion of the silicon material can be removed from the process as a component of the tar product. In some examples, about 28 wt. %, about 30 wt. %, about 32 wt. %, or about 34 wt. % to about 36 wt. %, about 38 wt. %, about 40 wt. %, or about 42 wt. % of the silicon material in the cooled steam cracker effluent can be removed from the process as a component of the steam cracker gas oil and/or the tar product. In some examples, the steam cracker gas oil can also include silicon, e.g., about 1 wt. % to about 40 wt. % of the silicon material in the cooled steam cracker quench oil.

The steam cracker naphtha contains a second amount of silicon, where the second amount of silicon is equal to the total mass of silicon present in all silicon forms in a given mass of steam cracker naphtha. The second amount can be about 5% to about 75% of the first amount of silicon, e.g., about 10% to about 60%, such as about 15% to about 52.5%, or about 20% to about 50%. Those skilled in the art will appreciate that the upper ends of these ranges can be utilized when determining the amount of hydroprocessing catalyst needed to hydroprocess the steam cracker naphtha for the predetermined period of time. Accordingly, when the first amount of silicon is known, a predetermined amount of silicon in all its forms in the steam cracker naphtha can be determined or estimated that is about 75% of the first amount, e.g., about 60% of the first amount, such as about 52.5% of the first amount, or about 50% of the first amount.

Certain aspects of the invention are therefore based in part on the discovery of how the various forms of silicon in the hydrocarbon feed are apportioned in a steam cracking process. Once the first amount of the silicon in all its forms in the hydrocarbon feed has been measured, estimated, or otherwise determined, the second amount of the silicon in all its forms in the steam cracker naphtha can be determined for the specified steam cracking configuration and process conditions. And once the second amount of the silicon in all its forms in the steam cracker naphtha has been determined, the amount of catalyst needed for naphtha hydroprocessing can also be determined, e.g., to allow the steam cracking process to operate for the predetermined period. In other words, (i) the amount and composition of silicon material in the hydrocarbon feed and (ii) the amount of catalyst needed in one or more catalyst beds disposed within one or more naphtha hydroprocessors to allow the steam cracking process to operate for the predetermined period of time can be predetermined from the from the types and amounts of the various forms of silicon constituting the silicon material in the hydrocarbon feed. Prior to starting the steam cracking process, a sufficient amount of catalyst can be loaded or otherwise disposed within the hydroprocessor to enable the steam cracker naphtha to be hydroprocessed for at least as long as the predetermined period of time. Once a sufficient amount of catalyst has been disposed within the hydroprocessor the hydrocarbon feed can be steam cracked and the steam cracking can continue for the predetermined period of time without requiring a shut down due to the silicon material in the steam cracker naphtha.

The amount of catalyst disposed within the hydroprocessor can be sufficient to allow one or more forms of silicon to accumulate on the catalyst in a silicon amount (total silicon included in all forms of silicon present on the catalyst) of about 0.3 wt. %, about 0.5 wt. %, about 1 wt. %, about 2 wt. %, or about 3 wt. % to about 5 wt. %, about 10 wt. %, or about 15 wt. % or more, based on a weight of the catalyst. It should be understood that the weight of the catalyst includes the catalytically active component and any optional support material and/or other optional component that is not catalytically active, at least in a hydroprocessing environment that a given catalyst can optionally include. The amount of silicon material a given catalyst can accommodate can depend, at least in part, on the particular catalyst and/or the particular processing conditions within the hydroprocessor.

After the second amount of silicon the steam cracker naphtha determined, and also typically the amount of silicon material (wt., basis) in the steam cracker naphtha is determined, one skilled in the art can readily calculate or otherwise determine the amount of catalyst that needs to be disposed within the one or more hydroprocessors to allow the steam cracking process to operate for the predetermined period of time. For any given amounts of the various forms of silicon in the steam cracker naphtha, the amount of catalyst that should be disposed within the one or more hydroprocessors can be determined, at least in part, on the particular catalyst, the mass flow rate of the steam cracker naphtha through the one or more hydroprocessors, the predetermined period of time, and/or the hydroprocessing conditions within the one or more hydroprocessors. Properties that can be taken into account with regard to the particular catalyst can include, but are not limited to, a surface area of the catalyst, a pore volume of the catalyst, a pore size of the catalyst, a catalyst particle size, and/or the type and amount of catalytically active material in the catalyst. Hydroprocessing conditions that can be taken into account can include, but are not limited to, temperature, pressure, hydrogen partial pressure, and/or weight hour space velocity, for example.

In some examples, the silicon material in the steam cracker naphtha can include about 0.01 wt. %, about 0.05 wt. %, about 0.1 wt. %, or about 0.2 wt. % to about 0.5 wt. %, about 0.7 wt. %, or about 1 wt. % of $C_5$-$C_6$ silicones, about 10 wt. %, about 15 wt. %, or about 20 wt. % to about 30 wt. %, about 35 wt. %, or about 50 wt. % of $C_7$-$C_9$ silicones, and about 60 wt. %, about 65 wt. %, or about 70 wt. % to about 80 wt. %, about 85 wt. %, or about 90 wt. % of $C_{10+}$ silicones, based on the weight of the silicon material in the steam cracker naphtha. In other examples, the silicon material in the steam cracker naphtha can include ≤1 wt. % of $C_5$-$C_6$ silicones, about 10 wt. % to about 50 wt. % of $C_7$-$C_9$ silicones, and about 60 wt. % to about 90 wt. % of $C_{10+}$ silicones, based on the weight of the silicon material in the steam cracker naphtha.

It is observed for a large variety of heavy hydrocarbon feeds that determining the amount (mass basis) of silicon material in the hydrocarbon feed also provides the amount (mass basis) of any organosilicon compounds in the feed relative to a combined amount (mass basis) of any elemental silicon and any inorganic silicon compounds in the feed. In one specific example, if the amount of the silicon material in the hydrocarbon feed is determined to be about 0.25 wppm, then the silicon material in the hydrocarbon feed is composed of about 0.15 wppm of organosilicon compounds and about 0.1 wppm of a combined amount of inorganic silicon compounds and elemental silicon. This distribution of silicon material in the hydrocarbon feed among (i) organosilicon compounds and (ii) the combination of inorganic silicon compounds and elemental silicon is observed for a wide variety of heavy hydrocarbon feeds and for a wide range in wppm of silicon material in the hydrocarbon feed, e.g., in a range of from about 0.01 wppm to about 1 wppm, such as from 0.05 wppm to 0.5 wppm. From these values, one skilled in the art can readily estimate the first silicon amount in the hydrocarbon feed from the amount of silicon material in the hydrocarbon feed.

It is also observed for a large variety of heavy hydrocarbon feeds that determining the amount (mass basis) of silicon material in the hydrocarbon feed also provides the relative amounts (mass basis) of elemental silicon, inorganic silicon compounds, and organosilicon compounds, with respect to one another. In a specific example, if the total the amount of silicon material (mass basis) in the hydrocarbon feed is determined to be about 0.2 wppm, then the relative amounts of the various forms of silicon material are present in the following amounts (mass basis): about 0.1 wppm of inorganic silicon compounds, about 0.08 wppm of organosilicon compounds, and about 0.02 wppm of elemental silicon. This distribution of silicon material in the hydrocarbon feed among (i) inorganic silicon compounds, (ii) organosilicon compounds, and (iii) elemental silicon is observed for a wide variety of heavy hydrocarbon feeds and for a wide range in wppm of silicon material in the hydrocarbon feed, e.g., in a range of from about 0.01 wppm to about 1 wppm, such as from 0.05 wppm to 0.5 wppm. From these values, one skilled in the art can readily determine the first silicon amount in the hydrocarbon feed. From these values, one skilled in the art can readily make an improved estimate of the first silicon amount in the hydrocarbon feed from the amount of silicon material in the hydrocarbon feed.

The steam cracker naphtha can be subjected to hydroprocessing conditions to produce a hydroprocessed steam cracker naphtha. The steam cracker naphtha typically comprises various forms of silicon. The silicon present in these various forms typically include at least a portion of the silicon that is present in various forms in the hydrocarbon feed. The hydroprocessing can be carried out in one or more hydroprocessing stages under hydroconversion conditions that can be independently selected for each stage, e.g., under conditions for carrying out one or more of pretreatment, hydrocracking (including selective hydrocracking), hydrogenation, hydrotreating, hydrodesulfurization, hydrodenitrogenation, hydrodemetallation, hydrodearomatization, hydroisomerization, or hydrodewaxing of the tar product as the case may be. In some examples, the steam cracker naphtha can be hydroprocessed in one or more hydroprocessing units that can include one or more hydroprocessing vessels or zones. The hydroprocessing vessel or zone can include one or more catalysts disposed therein. The catalyst can be in the form of a fixed catalyst bed, a circulating or slurry bed, or any other configuration. In some examples, the steam cracker naphtha, prior to being subjected to hydroprocessing can be subjected to one or more separation processes to remove at least a portion of any water and/or steam and/or to remove at least a portion of any $C_4$ and lighter hydrocarbons, for example.

In some examples, the steam cracker naphtha hydroprocessing conditions can include a temperature of about 40° C., about 75° C., or about 100° C. to about 200° C., about 300° C., or about 370° C. In some examples, the steam cracker naphtha hydroprocessing conditions can be carried out under an absolute pressure of about 600 kPa, about 1,000 kPa, or about 1,500 kPa to about 2,000 kPa, about 2,750 kPa, or about 4,000 kPa. In some examples, the steam cracker naphtha hydroprocessing conditions can be carried out at a weight hourly space velocity (WHSV) of about 1 $h^{-1}$, about 3 $hr^{-1}$, or about 5 $h^{-1}$ to about 8 $h^{-1}$, about 12 $h^{-1}$, or about 15 $h^{-1}$. In at least one example, the steam cracker naphtha hydroprocessing conditions can include a temperature of about 40° C. to about 370° C., an absolute pressure of about 600 kPa to about 4,000 kPa, and a weight hourly space velocity (WHSV) of catalyst of from about 1 $h^{-1}$ to about 15 $h^{1}$. Illustrative hydroprocessors and processes for operating same that can be used to hydroprocess the steam cracker naphtha can include those disclosed in U.S. Pat. No. 8,894,844; and U.S. Patent Application No.: 2016/0376511.

In some examples, hydroprocessing the steam cracker naphtha can include hydroprocessing the steam cracker naphtha under a first set of hydroprocessing conditions to produce an intermediate or pretreated steam cracker naphtha. The pretreated steam cracker naphtha can be hydroprocessed under a second set of hydroprocessing conditions to produce the hydroprocessed steam cracker naphtha. In certain aspects the first hydroprocessing conditions are substantially the same as the second hydroprocessing conditions, but in other aspects they are different.

In some examples, the steam cracker naphtha can be hydroprocessed under the first set of hydroprocessing conditions in the presence of molecular hydrogen and a first catalyst to produce a pretreated steam cracker naphtha and the pretreated steam cracker naphtha can be hydroprocessed under the second set of hydroprocessing conditions in the presence of molecular hydrogen and a second catalyst to produce the hydroprocessed steam cracker naphtha. In certain aspects, the first catalyst is substantially the same as the second catalyst, but in other aspects the catalysts are different. In some examples, the first catalyst can be or include nickel. For example, the first catalyst can be or include nickel sulfide. In some examples, the second catalyst can be or include nickel, molybdenum, cobalt, alloys thereof, or a mixture or combination thereof. In some examples, the second catalyst can be or include a nickel molybdenum catalyst and/or a cobalt molybdenum catalyst.

In some examples, the amount of first catalyst the steam cracker naphtha can be contacted with during the first hydroprocessing can be greater than the amount of second catalyst the pretreated steam cracker naphtha can be contacted with during the second hydroprocessing. In other examples, the amount of first catalyst the steam cracker naphtha can be contacted with during the first hydroprocessing can be less than the amount of second catalyst the pretreated steam cracker naphtha can be contacted with during the second hydroprocessing. In still other examples, the amount of first catalyst the steam cracker naphtha can be contacted with during first hydroprocessing can be about the same as the amount of second catalyst the pretreated steam cracker naphtha can be contacted with during the second hydroprocessing.

In some examples, when hydroprocessing the steam cracker naphtha includes two hydroprocessing units, about 5 wt. %, about 10 wt. %, about 12 wt. %, or about 15 wt. % to about 20 wt. %, about 25 wt. %, about 30 wt. %, about 35 wt. %, or about 40 wt. % of the silicon material in the steam cracker naphtha, based on the total weight of silicon material in the steam cracker naphtha, can be deposited, entrapped, contained, held, reacted, or otherwise disposed on the first catalyst. In some examples, about 60 wt. %, about 65 wt. %, or about 70 wt. % to about 80 wt. %, about 85 wt. %, about 90 wt. %, or about 95 wt. % of the silicon material in the pretreated steam cracker naphtha, based on the total weight of the silicon material in the steam cracker naphtha, can be deposited, entrapped, contained, held, reacted, or otherwise disposed on the second catalyst. Typically, when hydroprocessing the steam cracker naphtha includes two hydroprocessing units, about 5 wt. %, about 10 wt. %, about 12 wt. %, or about 15 wt. % to about 20 wt. %, about 25 wt. %, about 30 wt. %, about 35 wt. %, or about 40 wt. % of silicon derived from the silicon material in the steam cracker naphtha, based on the total weight of silicon as present in various forms in the steam cracker naphtha, can be deposited, entrapped, contained, held, reacted, or otherwise disposed on the first catalyst. For example, about 60 wt. %, about 65 wt. %, or about 70 wt. % to about 80 wt. %, about 85 wt. %, about 90 wt. %, or about 95 wt. % of silicon derived from silicon material in the pretreated steam cracker naphtha, based on the total weight of silicon as present in various forms in the steam cracker naphtha, can be deposited, entrapped, contained, held, reacted, or otherwise disposed on the second catalyst.

Once a sufficient amount of catalyst is introduced into the hydroprocessing unit to allow the hydroprocessing unit to hydroprocess the steam cracker naphtha that can be separated from the steam cracker effluent for at least as long as the predetermined period of time, the steam cracking process can be started and the hydrocarbon feed can be steam cracked. For example, once a sufficient amount of the first catalyst has been introduced into the first hydroprocessing unit and a sufficient amount of the second catalyst has been introduced into the second hydroprocessing unit to allow the hydroprocessing unit to hydroprocess the steam cracker naphtha that can be separated from the steam cracker effluent for at least as long as the predetermined period of time, the steam cracking process can be started and the hydrocarbon feed can be steam cracked for at least as long as the predetermined period of time without requiring replacement or re-activation of the first and second catalysts due to catalyst deactivation caused by the silicon material present in the steam cracker naphtha.

In some examples, when hydroprocessing the steam cracker naphtha includes hydroprocessing under the first set of hydroprocessing conditions to produce the pretreated steam cracker naphtha and hydroproces sing the pretreated steam cracker naphtha under the second set of hydroprocessing conditions to produce the hydroprocessed steam cracker naphtha, the first catalyst and the second catalyst can become insufficiently effective, deactivated, or otherwise spent when the same or different amounts of silicon material becomes deposited, entrapped, contained, held, reacted, or otherwise disposed on the first catalyst and the second catalyst. An increase in pressure drop across the hydroprocessing reactor from inlet to outlet can be an indication of catalyst ineffectiveness. For example, an increase in hydroprocessing reactor pressure drop by a factor of 1.1 times the reactor's pressure drop at the start of hydroprocessing can be an indication of catalyst ineffectiveness, e.g., 1.2 times, or 1.5 times, or 1.75 times, or 2 times.

In some examples, if the first set of hydroprocessing conditions selectively hydrogenates dienes to monoolefins (with some hydrodesulfurizaton optionally occurring) and the second set of hydroprocessing conditions selectively hydrodsulfurizes (with some hydrogenation optionally occurring), the first catalyst can become insufficiently effective, deactivated, or otherwise spent when the first catalyst accumulates a first amount of silicon material and the second catalyst can become insufficiently effective, deactivated, or otherwise spent when the second catalyst accumulates a second amount of silicon material. The first amount can be less than, equal to, or greater than the second amount. In some examples, the first catalyst can become insufficiently effective, deactivated, or otherwise spent when the first catalyst accumulates about 0.3 wt. %, about 0.4 wt. %, about 0.5 wt. %, or about 0.6 wt % to about 0.7 wt. %, about 0.8 wt. %, about 0.9 wt. %, about 1 wt. %, about 1.1 wt. %, about 1.2 wt. %, about 1.3 wt. %, about 1.4 wt. %, or about 1.5 wt. % of silicon material (or silicon derived from the silicon material) disposed thereof, based on the weight of the catalyst. In this example, it has also been discovered that the second catalyst can become insufficiently effective, deactivated, or spent when the catalyst accumulates about 2 wt. %, about 2.5 wt. %, about 3 wt. %, about 3.5 wt. %, about 4 wt. %, or about 5 wt. % to about 6 wt. %, about 7 wt. %, about 8 wt. %, about 9 wt. %, about 10 wt. %, about 11 wt. %, about 12 wt. %, about 13 wt. %, about 14 wt. %, or about 15 wt. % of silicon material (or silicon derived from silicon material) disposed thereof, based on the weight of the catalyst. It should be understood that the development of more robust catalysts could lead to an increase in the amount of silicon material that could be disposed on the first catalyst and/or the second catalyst before the catalyst becomes insufficient effected, deactivated, or otherwise spent.

Certain aspects of the invention will now be described with reference to FIG. 1, which includes a vapor-liquid separator integrated with a steam cracking furnace's convection section. The invention is not limited to these aspects, and this description should not be interpreted as excluding other aspects within the broader scope of the invention, such as aspects that do not include such a vapor-liquid separator.

FIG. 1 schematically shows system 100 for steam cracking a hydrocarbon feed in line 101, separating products therefrom including steam cracker naphtha via line 131, and hydroprocessing the steam cracker naphtha in line 131 for at least as long as a predetermined period of time, according to one or more aspects. The hydrocarbon feed, e.g., a feed containing $C_{5+}$ hydrocarbons, via line 101 and an aqueous stream comprising water, steam, or a mixture of water and steam via line 102 can be mixed, blended, combined, or otherwise contacted to produce a steam cracking feed, which is conducted via line 103. In certain aspects, the hydrocarbon feed of line 101 is preheated in convection section 106 of a furnace 105 before it is combined with the aqueous stream of line 102. In some examples, the hydrocarbon feed can be or include the hydrocarbons or hydrocarbon feedstocks disclosed in U.S. Pat. Nos. 7,993,435; 8,696,888; 9,327,260; 9,637,694; 9,657,239; and 9,777,227; and P.C.T. Patent Application Publication No. WO 2018/111574.

In certain aspects, the hydrocarbon feed is introduced for preheating into an inlet of at least one convection coil located in the steam cracking furnace's convection section. The preheating of the hydrocarbon feed may include indirect contact of the feed in the convection section of the steam cracker with hot flue gases traveling upward from the radiant section of the furnace. Typically, the hydrocarbon feed is divided among a plurality of convection coils.

These can have the form of a bank of heat exchange tubes located within the convection section of the steam cracker. Typically, the amount of the aqueous stream in the steam cracking feed of line 103 is >5 wt. % based on the weight of the steam cracking feed, e.g., in a range of from about 10 wt. % to about 90 wt. %, or about 10 wt. % to about 95 wt. Typically >90 wt. % of the remainder of the steam cracking feed is the preheated hydrocarbon feed, e.g., ≥95 wt. %, such as ≥99 wt. %. In certain aspects, the steam cracking feed has a weight ratio of steam to hydrocarbon feed in the range of from about 0.1 to about 1, such as about 0.2 to about 0.6.

The steam cracking feed in line 103 can be heated, e.g., to a temperature of about 200° C. to about 585° C., to produce a heated steam cracking feed. For example, the steam cracking feed in line 103 can be heated in a convection section 106 of a furnace 105 to produce the heated steam cracking feed via line 108.

A vapor phase product and a liquid phase product can be separated from the heated steam cracking feed by introducing the heated steam cracking feed via line 108 into one or more separators of a "first separation stage" 110, e.g., one or more flash separators. The vapor phase product via line 111 and the liquid phase product via line 112 (the pyrolysis feed) can be conducted away from the first separation stage 110. Although it is applicable in other aspects, utilizing a first separation stage in the process is particularly suitable when the hydrocarbon feed or preheated hydrocarbon feed includes about 0.1 wt. % or more of asphaltenes based on the weight of the hydrocarbon feed, e.g., about 5 wt. % or more. In some examples, the first separation stage 110 can be or include the separators and/or other equipment disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; 6,632,351; 7,578,929; and 7,235,705. The first separation stage can be configured (e.g., by selecting a vapor-liquid cut point) to remove about 5 wt. % to 95 wt. % (or about 25 wt. % to about 75 wt. %) of the silicon material in the hydrocarbon feed in line 101 as a component of the liquid-phase bottoms stream via line 112. As such, in some examples, about 5 wt. % to about 95 wt. % (or about 25 wt. % to about 75 wt. %) of the silicon material in the hydrocarbon feed in line 101 can be a component of the vapor phase product (the pyrolysis feed) in line 111. The bottoms stream may include, for example, (i) at least about 5 wt. % of the hydrocarbon feed's total silicon content (all forms of silicon), and (ii) at least about 10 wt. % of asphaltenes in the hydrocarbon feed. Typically, ≥10 wt. % of the hydrocarbon feed's total silicon content (all forms of silicon) resides in the bottoms stream, e.g., ≥15 wt. %, such as ≥20 wt. %, or ≥25 wt. %, or ≥30 wt. %., or in a range of about 5 wt. % to 50 wt. %, or about 10 wt. % to 30 wt. %; with ≥75 wt. % of the balance of the hydrocarbon feed's total silicon content residing in the pyrolysis feed, e.g., ≥90 wt. %.

It has been found that utilizing the first separation stage increases the variety of hydrocarbon feeds that can be introduced into the steam cracking furnace with little if any pretreatment. For example, utilizing a first separation stage having at least one flash separation vessel integrated with the steam cracking furnace's convection section has been found to facilitate the steam cracking of a wide range of hydrocarbon feeds, including those comprising ≥50 wt. % of one or more of medium hydrocarbon, heavy hydrocarbon, raw heavy hydrocarbon, raw medium hydrocarbon, desalted heavy hydrocarbon and/or desalted medium hydrocarbon, heavy and/or medium crude oil, desalted heavy crude oil and/or desalted medium crude oil, etc., such as ≥75 wt. %, or ≥90 wt. %, based on the weight of the hydrocarbon feed.

It also has been found that utilizing the first separation stage results in improved management of undesired contaminants in the steam cracking feed because vapor-phase contaminants (e.g., those transferred to the pyrolysis feed) may be kept within predetermined limits. In certain aspects, utilizing the first separation stage advantageously transfers to the bottoms stream ≥50 wt. % of any salts and particulates in the liquid-phase portion of the steam cracking feed, e.g., ≥75 wt. %, such as ≥90 wt. %, or ≥99 wt. %. The composition of the hydrocarbon feed conducted to the steam cracking furnace, the amount of the hydrocarbon feed conducted to the furnace, the amount of preheating of the hydrocarbon feed, the amount of dilution steam combined with the preheated hydrocarbon feed, and the amount of any heating of the steam cracking feed upstream of the first separation stage are typically selected to achieve a vaporization of ≥2 wt. % of the hydrocarbon portion of the steam cracking feed at the location where the steam cracking feed enters the separation vessel, e.g., ≥5 wt. %, such as ≥10 wt. %, or ≥20 wt. %, or ≥50 wt. %, or ≥75 wt. %, or ≥90 wt. %, or ≥95 wt. % or more. For example, these selections can be made to achieve a vaporization of the hydrocarbon portion of the steam cracking feed in a range of about 5 wt. % to about 98 wt. %, e.g., about 10 wt. % to about 95 wt. %, such as about 20 wt. % to about 80 wt. %, or about 25 wt. % to about 75 wt. %. Typically, ≥75 wt. % of the remainder of the hydrocarbon portion of the steam cracking feed (the portion that is not in the vapor phase) is in the liquid phase, e.g., ≥90 wt. %, or ≥95 wt. %.

The composition (and hence properties such as viscosity and API gravity) of the hydrocarbon portion of the steam cracking feed, the flow velocity of the steam cracking feed (particularly the flow velocity of the liquid portion of the steam cracking feed), and the type and amounts of salts and/or particulate matter in these flows can be selected to achieve a predetermined liquid-phase amount of the steam cracking feed. For feeds exhibiting a lesser flow velocity, particularly a lesser flow velocity of the liquid-phase portion, a greater amount of the steam cracking feed in the liquid-phase is indicated. This is typically the case when the hydrocarbon feed comprises a more viscous, generally heavier, hydrocarbon. It is generally desirable to select these properties and conditions to maintain about 2% or greater of the hydrocarbon portion of the steam cracking feed in the liquid phase at the location where the steam cracking feed enters the separation vessel, such as about 5% or greater, on a weight basis.

The first separation stage can include at least one flash separation vessel operating at a temperature from about 315° C. to about 510° C. and/or a pressure from about 275 kPa to about 1400 kPa, such as, a temperature from about 430° C. to about 480° C., and/or a pressure from about 700 kPa to about 760 kPa. Depending on the composition of the hydrocarbon feed and the conditions utilized in the convection section and flash separation vessel, the various forms of sulfur present in the pyrolysis feed might differ from those of the hydrocarbon feed. The bottoms stream can be conducted away from the flash separation vessel, e.g., for storage and/or further processing. The silicon-lean, primarily vapor-phase pyrolysis feed is conducted to the radiant section for pyrolysis. Optionally, the pyrolysis feed can be subjected to further heating in the convection section before it is introduced into the radiant section.

Those skilled in the art will appreciate that a wide range of pyrolysis conditions can be used, and that the selection of particular pyrolysis conditions will depend, e.g., on the composition of the selected hydrocarbon feed and the relative amounts of the various products and co-products in the steam cracker effluent, e.g., the relative amounts of ethylene and propylene. For example, the pyrolysis conditions typically include heating the pyrolysis feed in a radiant coil to achieve a temperature of the radiant coil effluent (measured at the outlet of the radiant coil) of about 400° C. or greater, such as from about 400° C. to about 1100° C., a pressure (as measured at the radiant coil outlet) of about 10 kPa or greater, and a residence time in the radiant coil of from about 0.01 second to 5 seconds. In certain aspects, e.g., those in which the hydrocarbon feed includes crude oil or desalted crude oil, pyrolysis conditions can include one or more of (i) a temperature of about 760° C. or greater, such as from about 760° C. to about 1100° C., or from about 790° C. to about 880° C., (ii) a pressure of about 50 kPa or greater, such from about 60 kPa to about 500 kPa, or from about 90 kPa to about 240 kPa; and/or (iii) a residence time from about 0.1 seconds to about 2 seconds. For hydrocarbon feeds containing lighter hydrocarbon, it is typical to utilize a temperature in the range of from about 760° C. to about 950° C. The specified steam cracking conditions may be sufficient to convert by pyrolysis at least a portion of the pyrolysis feed's hydrocarbon molecules to $C_{2+}$ olefins and a portion of the pyrolysis feed's sulfur to forms of lesser molecular weight.

In certain aspects, the pyrolysis feed in line 111 can be heated to a temperature of ≥400° C., e.g., a temperature of about 425° C. to about 825° C., and introduced to a radiant section 107 of the furnace 105 to produce a steam cracker effluent that can be conducted away via line 113. In some examples, the vapor phase product in line 111 can be heated in the convection section 106 of the furnace 105 prior to introducing the vapor phase product into the radiant section 107 of the furnace 105. In some examples, additional water and/or steam can be mixed, blended, combined, or otherwise contacted with the pyrolysis feed before it is introduced into the radiant section 107 of the furnace 105 for pyrolysis (steam cracking). In some examples, the pyrolysis feed in line 111 can be steam cracked according to the processes and systems disclosed in U.S. Pat. Nos. 6,419,885; 7,993,435; 9,637,694; and 9,777,227; U.S. Patent Application Publication No. 2018/0170832; and P.C.T. Patent Application Publication No. WO 2018/111574.

The steam cracker effluent generally includes unconverted constituents of the pyrolysis feed and pyrolysis products. The pyrolysis products generally include $C_{2+}$ olefin, molecular hydrogen, acetylene, aromatic hydrocarbon, saturated hydrocarbon, $C_{3+}$ diolefin, aldehyde, $CO_2$, steam cracker tar, and various forms of silicon. In some examples, the steam cracker effluent via line 113 can be introduced to one or more separators of a "second separation stage" 125. In other examples, the steam cracker effluent in line 113 can be mixed, blended, combined, or otherwise contacted with a quench fluid in line 127 to produce a cooled steam cracker effluent in line 120 that can be introduced into the second separation stage 125. In some examples, the steam cracker effluent in line 113 can be at a temperature of ≥300° C., ≥400° C., ≥500° C., ≥600° C., or ≥700° C., or ≥800° C., or more. In certain aspects, the greatest temperature of the steam cracker effluent in line 113 can be in the range of about 425° C. to 850° C., e.g., about 450° C. to about 800° C., when initially contacted with the quench fluid in line 127.

Those skilled in the art will appreciate that the amount of the quench fluid contacted with the steam cracker effluent should be sufficient to cool the steam cracker effluent to facilitate separation of the desired products in the second separation stage 125, e.g., a primary fractionator. Although the amount of quench fluid needed to do this can vary considerably from facility to facility, the quench fluid to steam cracker effluent weight ratio is typically in the range of from about 0.1 to about 10, e.g., 0.5 to 5, such as 1 to 4. The desired weight ratio in a particular instance can be determined, e.g., from any one or more of a number of factors such as the amount of steam cracker effluent to be cooled, the temperature of the steam cracker effluent at the quenching location, the composition and thermodynamic properties (e.g., enthalpy, Cp, etc.) of the quench fluid and the steam cracker effluent, the desired temperature of the quench fluid—steam cracker effluent mixture (namely the cooled steam cracker effluent) at the primary fractionator inlet, etc. For example, in certain aspects the cooled steam cracker effluent in line 120 can include the quench fluid in an amount of about 5 wt. % to about 95 wt. %, about 25 wt. % to about 90 wt. %, or about 50 wt. %, or about 80 wt. %, based on the weight of the cooled steam cracker effluent.

As shown in FIG. 1, a steam cracker quench oil via line 127 conducted away from the second separation stage 125 can be contacted with the steam cracker effluent in line 113 to produce the cooled steam cracker effluent in line 120. In some examples, in lieu of or in addition to using the steam cracker quench oil to cool the steam cracker effluent in line 113, a steam cracker gas oil via line 133 and/or one or more utility fluid products can be used. Suitable utility fluid products can include those disclosed in U.S. Pat. Nos. 9,090,836; 9,637,694; and 9,777,227; and P.C.T. Patent Application Publication No. WO 2018/111574.

In some examples, a plurality of products can be recovered from the second separation stage 125. For example, an overhead or process gas via line 129, a steam cracker naphtha via line 131, the steam cracker gas oil via line 133, the steam cracker quench oil via line 127, and/or a tar product via line 135 can be conducted away from the second separation stage 125. In some examples, products that can be separated from the process gas in line 129 can include, but are not limited to, a tail gas, ethane, ethylene, propane, propylene, crude $C_4$ hydrocarbons, or any combination thereof. The second separation stage 125 can be or include one or more fractionators, knockout drums, a combined quench tower and primary fractionator, a compressor, contaminant removal units, e.g., $CO_2$ and/or $H_2S$ removal units, acetylene converter, etc.

In some examples, conventional separation equipment can be used to separate the various products, e.g., the steam cracker naphtha, from the cooled steam cracker effluent. For example, one or more flash drums, knock out drums, fractionators, water-quench towers, indirect condensers, etc. In some examples, illustrative separation stages can include those disclosed in U.S. Pat. No. 8,083,931, for example. In other examples, the products that can be separated from the cooled steam cracker effluent, e.g., the steam cracker naphtha, can be separated according to the processes and systems disclosed in U.S. Patent Application Publication No. 2014/0357923.

In some examples, at least a portion of the steam cracker naphtha via line 131 and molecular hydrogen via line 132 can be introduced into one or more hydroprocessing units 155 to produce a hydroprocessed steam cracker naphtha via line 163. The steam cracker naphtha can be hydroprocessed in the presence of the molecular hydrogen and one or more catalysts, e.g., catalyst bed 160, under hydroprocessing conditions sufficient to produce a hydroprocessed steam cracker naphtha that can be conducted away via line 163. Hydroprocessing the steam cracker naphtha can convert one or more diolefins in the steam cracker naphtha to monoolefins, convert one or more olefins in the steam cracker naphtha to paraffin, convert one or more sulfur compounds in the steam cracker naphtha to hydrogen sulfide, an/or produce dimers.

The steam cracker naphtha via line 131 can be introduced into the hydroprocessor 155 as recovered from the second separator 125. Alternatively or in additions, the steam cracker naphtha can be processed prior to introduction into the hydroprocessor 155. For example, the steam cracker naphtha can include water, steam, and/or light hydrocarbons, e.g., $C_4$ hydrocarbons. As such, the steam cracker naphtha in line 131 can be introduced into one or more separation stages. In some examples, the steam cracker naphtha via line 131 can be introduced into one or more separators of a third separation stage configured to remove at least a portion of any water included therein to produce a water-lean steam cracker naphtha that can be introduced into the steam cracker naphtha hydroprocessor 155. In other examples, the water-lean steam cracker naphtha can be introduced into one or more separators of a fourth separation stage to separate at least a portion of any $C_4$ and lighter hydrocarbons that can be included therewith. As such, in some examples, the steam cracker naphtha introduced via line 131 to the steam cracker hydroprocessor 155 can be introduced directly from the second separation stage 125 or can undergo one or more additional separations or other processing to produce the steam cracker naphtha that can be introduced into the steam cracker hydroprocessor 155.

In some examples, the steam cracker naphtha in line 131 can be divided or otherwise portioned into a plurality of portions, e.g., a first steam cracker naphtha and a second steam cracker naphtha, having substantially the same composition. The first steam cracker naphtha can be subjected to the hydroprocessing conditions to produce the hydroprocessed steam cracker naphtha. The second steam cracker naphtha can be recycled to the second separation stage 125, e.g., as reflux. The option of separating the steam cracker naphtha into two or more portions, separating water from the steam cracker naphtha, separating $C_4$ hydrocarbons from the steam cracker naphtha, and/or other processing thereof can included those disclosed in U.S. Patent Application Publication No. 2016/0376511.

The catalyst bed 160 can be or include any catalyst capable of hydroprocessing the steam cracker naphtha. For example, the catalyst can be or include, but is not limited to, one or more elements selected from Groups 7-10 of the Periodic Table and optionally one or more elements selected from Groups 4-6 of the Periodic Table. In some examples, the catalyst can include ≥1 wt. % of one or more of Pt, Pd, Ni, Co, Mo, and W, based on the weight of the catalyst. In some examples, the catalyst can include one or more refractory oxides, e.g., silica and/or alumina as binder or support material. Conventional steam cracker naphtha catalysts can be used, but the processes and systems disclosed herein are not limited thereto.

The steam cracker naphtha hydroprocessing conditions in hydroprocessor 155 can include a temperature of about 40° C., about 75° C., or about 100° C. to about 200° C., about 300° C., or about 375° C. The steam cracker naphtha hydroprocessing conditions in hydroprocessor 155 can be carried out under an absolute pressure of about 600 kPa, about 1,000 kPa, or about 1,500 kPa to about 2,000 kPa, about 2,750 kPa, or about 4,000 kPa. The steam cracker naphtha hydroprocessing conditions in hydroprocessor 155 can be carried out at a weight hourly space velocity (WHSV) of about 1 $h^{-1}$, about 3 $hr^{-1}$, or about 5 $h^{-1}$ to about 8 $h^{-1}$, about 12 $h^{-1}$, or about 15 $h^{-1}$. In some examples, the steam cracker naphtha hydroprocessing conditions in hydroprocessor 155 include a temperature of about 40° C. to about 370° C., an absolute pressure of about 600 kPa to about 4,000 kPa, and a weight hourly space velocity (WHSV) of catalyst of from about 1 $h^{-1}$ to about 15 $h^{-1}$. Illustrative hydroprocessors and processes for operating same that can be used to hydroprocess the steam cracker naphtha can include those disclosed in U.S. Pat. No. 8,894,844; and U.S. Patent Application Nos.: 2007/0170098; and 2016/0376511.

Figure 2:
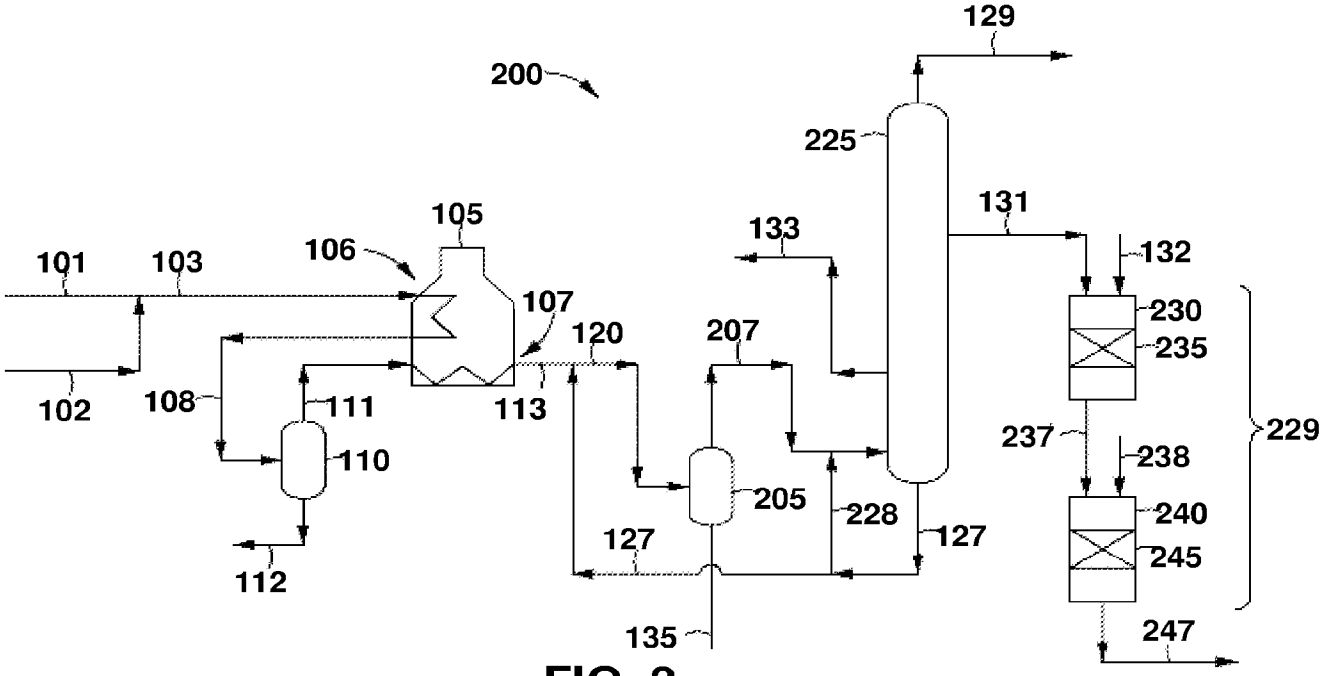
FIG. 2 depicts a schematic of another illustrative system for steam cracking the hydrocarbon feed, separating products therefrom including steam cracker naphtha, and hydroprocessing the steam cracker naphtha for at least as long as a predetermined period of time, according to one or more embodiments.

FIG. 2 depicts a schematic of another illustrative system 200 for steam cracking the hydrocarbon feed in line 101, separating products therefrom including steam cracker naphtha via line 131, and hydroprocessing the steam cracker naphtha in line 131 for at least as long as a predetermined period of time, according to one or more embodiments. The system 200 can be similar to the system 100. As shown, the system 200 can include one or more separators of a third separation stage 205 that can separate the tar product via line 135 from the cooled steam cracker effluent in line 120, prior to introducing the cooled steam cracker effluent into one or more separators of a "second separation stage" 225. More particularly, the cooled steam cracker effluent via line 120 can be introduced into the third separation stage 205 and an overhead via line 207 and a tar product via line 209 can be conducted away therefrom. The overhead via line 207 can be introduced into the second separation stage 225 and the process gas via line 129, steam cracker naphtha via line 131, steam cracker gas oil via line 133, and steam cracker quench oil via line 227 can be conducted away therefrom as discussed and described above with reference to FIG. 1. In some examples, the overhead in line 207 can be further cooled by mixing, blending, combining, or otherwise contacting the overhead with the steam cracker quench oil via line 228. In other examples, in addition to or in lieu of contacting the overhead in line 207 the steam cracker quench oil via line 228, the steam cracker gas oil via line 133, a portion of the steam cracker naphtha via line 131, and/or one or more utility fluids can be contacted with the overhead in line 207 to further cool the overhead.

The system 200 can also include a hydroprocessing unit 229 that can include two or more hydroprocessors (two are shown, 230, 240). The steam cracker naphtha via line 131 and molecular hydrogen via line 132 can be introduced into the first hydroprocessor 230. The steam cracker naphtha can be hydroprocessed in the presence of the molecular hydrogen and a first catalyst, e.g., first catalyst bed 235, to produce an intermediate or pretreated steam cracker naphtha that can be conducted away via line 237. In some examples, the first hydroprocessor 230 can be operated under conditions that favor the hydrogenation of dienes to monoolefins versus hydrodesulfurization. The pretreated steam cracker naphtha via line 237 and molecular hydrogen via line 238 can be introduced into the second hydroprocessor 240. In some examples, in addition to or in lieu of introducing molecular hydrogen via line 238, molecular hydrogen can be cascaded from the first hydroprocessor 230 into the second hydroprocessor 240 with the pretreated steam cracker naphtha via line 237. The pretreated steam cracker naphtha can be hydroprocessed in the presence of the molecular hydrogen and a second catalyst, e.g., second catalyst bed 245, to produce the hydroprocessed steam cracker naphtha that can be conducted away via line 247. In some examples, the second hydroprocessor 240 can be operated under conditions that favor desulfurization of the hydrogenated product recovered from the first hydroprocessor 230 as compared to the hydrogenation of dienes to monoolefins.

The steam cracker naphtha can be hydroprocessed under first hydroprocessing conditions in the first hydroprocessor 230 and the pretreated steam cracker naphtha can be hydroprocessed under second hydroprocessing conditions in the second hydroprocessor 240. The first hydroprocessing conditions can be the same or different than the second hydroprocessing conditions.

In some examples, the first hydroprocessing conditions in the first hydroprocessor 230 can include a temperature of about 40° C., about 75° C., or about 100° C. to about 200° C., about 300° C., or about 375° C. The first hydroprocessing conditions in the first hydroprocessor 230 can be carried out under an absolute pressure of about 600 kPa, about 1,000 kPa, or about 1,500 kPa to about 2,000 kPa, about 2,750 kPa, or about 4,000 kPa. The first hydroprocessing conditions in the first hydroprocessor 230 can be carried out at a weight hourly space velocity (WHSV) of about 1 $h^{-1}$, about 3 $hr^{-1}$, or about 5 $h^{-1}$ to about 8 $h^{-1}$, about 12 $h^{-1}$, or about 15 $h^{-1}$.

In some examples, the second hydroprocessing conditions in the second hydroprocessor 240 can include a temperature of about 40° C., about 75° C., or about 100° C. to about 200° C., about 300° C., or about 375° C. The first hydroprocessing conditions in the first hydroprocessor 230 can be carried out under an absolute pressure of about 600 kPa, about 1,000 kPa, or about 1,500 kPa to about 2,000 kPa, about 2,750 kPa, or about 4,000 kPa. The first hydroprocessing conditions in the first hydroprocessor 230 can be carried out at a weight hourly space velocity (WHSV) of about 1 $h^{-1}$, about 3 $hr^{-1}$, or about 5 $h^{-1}$ to about 8 $h^{-1}$, about 12 $h^{-1}$, or about 15 $h^{-1}$.

The first hydroprocessing conditions can be the same as or differ from the second hydroprocessing conditions. In some examples, the first hydroprocessing conditions can be sufficient to favor the hydrogenation of dienes to monoolefins over desulfurization of the steam cracker naphtha and the second stage hydroprocessing conditions can be sufficient to favor the desulfurization of the pretreated steam cracker naphtha over the hydrogenation of dienes. In other examples, the first hydroprocessing conditions can be sufficient to favor the desulfurization of the steam cracker naphtha over the hydrogenation of dienes in the steam cracker naphtha and the second stage hydroprocessing conditions can be sufficient to favor the hydrogenation of dienes in the pretreated steam cracker naphtha over the desulfurization of the pretreated steam cracker naphtha. In some examples, the temperature within the first hydroprocessor 230 can be lower than the temperature within the second hydroprocessor 240. It should be understood that hydrogenation and desulfurization can occur in both the first hydroprocessor and the second hydroprocessor. In some examples, suitable hydroprocessors and/or hydroprocessing conditions for the first hydroprocessor and/or the second hydroprocessor can include those disclosed in U.S. Pat. Nos. 5,807,477; 5,679,241; 5,851,383; 8,163,167; 8,894,844; and U.S. Patent Application No.: 2007/0170098; and 2016/0376511.

The first hydroprocessor 230 and the second hydroprocessor 240 can include any type of hydroprocessor. Conventional hydroprocessors can be used, but the invention is not limited thereto. In some examples, the first hydroprocessor 230 and the second hydroprocessor 240 can be or include fixed bed reactors, e.g., down flow fixed bed reactors, expanded bed reactors, reactive distillation columns, and/or other types of hydroprocessors.

Prior to steam cracking the hydrocarbon feed in line 101 in the steam cracking systems 100 and 200, the amount of catalyst that needs to be disposed within the hydroprocessing units 155, 229 to allow the steam cracking systems 100 and 200 to operate for the predetermined period of time can be calculated or otherwise determined. As discussed above, it has been surprisingly and unexpectedly discovered that if the hydrocarbon feed in line 101 includes silicon material, the silicon material can render the catalyst, e.g., catalyst beds 160, 235, 245, disposed within the hydroprocessing units 155, 229 insufficiently effective before the silicon material renders another processing unit ineffective. As such, the amount of catalyst needed to be disposed within the catalyst beds 160, 235, 245 to allow the hydroprocessing units 155, 229 to operate for at least as long as the predetermined period of time can be determined based, at least in part, on the amount of silicon material in the hydrocarbon feed in line 101. Prior to steam cracking the hydrocarbon feed in line 101, a sufficient amount of catalyst can be disposed in the catalyst beds 160, 235, 245 to allow the hydroprocessing units 155, 229 to be capable of hydroprocessing the steam cracker naphtha for at least as long as the predetermined period of time before the catalyst becomes insufficiently effective and requires shutting down the steam cracking systems 100, 200 for regeneration and/or replacement thereof.

Other Aspects of the Invention

In other aspects, the invention relates to processes, systems, and apparatus for hydrocarbon upgrading carried out for a predetermined period of time. The hydrocarbon upgrading can include a variety of processes for producing a process effluent from one or more of the indicated hydrocarbon feeds, e.g., thermal conversion processes such as pyrolysis (including, e.g., steam cracking), catalytic conversion processes, etc. These and other aspects can include measuring a first amount of silicon (the total mass of silicon that is present in all silicon forms in the hydrocarbon feed). A second amount of silicon can be determined from the first amount of silicon, where the second amount of silicon is equal to the total mass of silicon that is present in all silicon forms in a naphtha boiling-range stream that is separated from the process effluent. The second amount of silicon is predetermined from the first amount of silicon and optionally from conditions utilized in the hydrocarbon upgrading, e.g., unit configurations and/or process conditions. A sufficient amount of one or more catalysts can be introduced into a hydroprocessing unit to allow the hydroprocessing unit to hydroprocess the naphtha boiling-range stream for at least as long as the predetermined period of time without requiring replacement or re-activation of the one or more catalysts as a result of deactivation caused by silicon present in various forms in the naphtha boiling-range stream. In these and other aspects, naphtha boiling-range streams can have an atmospheric boiling point range of from an initial boiling point of about 30° F. (1.1° C.) to about 500° F. (260° C.), such as from about 40° F. (4.4° C.) to about 450° F. (232° C.), or from about that of mixed $C_5$ hydrocarbon to 430° F. (221° C.).

The invention also relates to systems, methods, and apparatus for carrying out all or a part of any of the indicated pyrolysis, steam cracking, hydrocarbon upgrading, and separations. For example, the upgrading of a hydrocarbon feed or a predetermined period of time can include a steam cracker, a first separator, a second separator, and a hydroprocessing unit. The steam cracker can be configured to combine and indirectly heat (in any order) an aqueous composition comprising water and/or steam and one or more of the indicated hydrocarbon feeds to produce a steam cracking feed. A pyrolysis feed comprising at least a vapor portion of the steam cracking feed can be separated from the steam cracking feed, e.g., in one or more first separators, such as in one or more vapor-liquid separators (e.g., one or more flash drums). The pyrolysis feed can be pyrolysed in one or more radiant coils in a steam cracking furnace to produce a steam cracker effluent. A second separator can be configured to separate a steam cracker naphtha and a process gas that can include ethylene and propylene from the steam cracker effluent. The hydroprocessing unit that can include one or more catalysts disposed therein. The hydroprocessing unit can be configured to hydroprocess the steam cracker naphtha in the presence of the one or more catalysts and molecular hydrogen for at least as long as a predetermined period of time without requiring replacement or re-activation of the one or more catalysts as a result of catalyst deactivation caused by one or more forms of silicon present in the steam cracker naphtha. In some examples, an amount of the one or more catalysts in the hydroprocessing unit can be determined according to a process. For example, the first amount of silicon material (and/or the amount of silicon in its various forms) in the hydrocarbon feed can be measured. The first amount of silicon can be used to determine the second amount of silicon (and/or silicon material) in the steam cracker naphtha. The amount of the one or more catalysts that should be disposed in the hydroprocessing unit can be determined based, at least in part, on the second amount of silicon. Improved accuracy in determination of the second amount of silicon can be realized by making use of process configurations and process conditions, e.g., by setting a predetermined cut point in the first and/or second separators.

In these and other aspects, the hydrocarbon can be or include, but is not limited to, naphtha, gas oil, vacuum gas oil, a waxy residue, an atmospheric residue, a crude oil, or a mixture thereof. The hydrocarbon feed is steam cracked under steam cracking conditions to produce a steam cracker effluent. A steam cracker naphtha is separated from the steam cracker effluent, where the steam cracker naphtha has a second amount of silicon that is equal to the total mass of silicon present in all silicon forms in the steam cracker naphtha. Silicon forms present in the steam cracker naphtha can include: ≤1 wt. % of $C_5$-$C_6$ silicones, about 10 wt. % to about 50 wt. % of $C_7$-$C_9$ silicones, and about 60 wt. % to about 90 wt. % of $C_{10+}$ silicones, where the weight percents are based on the combined weight of all silicon forms present in the steam cracker naphtha. The steam cracker naphtha can be hydroprocessed for at least as long as the predetermined period of time in a first hydroprocessing unit to produce the pretreated steam cracker naphtha. The pretreated steam cracker naphtha can be hydroprocessed for at least as long as the predetermined period of time in a second hydroprocessing unit to produce a hydroprocessed steam cracker naphtha.

A sufficient amount of one or more first catalysts can be introduced into a first hydroprocessing unit to allow the first hydroprocessing unit to hydroprocess the steam cracker naphtha that is to be separated from the steam cracker effluent for at least as long as a predetermined period of time without requiring replacement or re-activation of the one or more first catalysts resulting from catalyst deactivation caused by the silicon present in one or more forms in the steam cracker naphtha. A sufficient amount of one or more second catalysts can be introduced into a second hydroprocessing unit to allow the second hydroprocessing unit to hydroprocess a pretreated steam cracker naphtha that is to be recovered from the first hydroprocessing unit for at least as long as a predetermined period of time without requiring replacement or re-activation of the one or more second catalysts resulting from catalyst deactivation caused by the silicon present in one or more forms in the pretreated steam cracker naphtha.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A process for upgrading a hydrocarbon for a predetermined period of time, comprising:

determining a first amount of silicon material present in a hydrocarbon feed that is to be steam cracked in a steam cracker to produce a steam cracker effluent;

determining a second amount of silicon material that will be present in a steam cracker naphtha that is to be separated from the steam cracker effluent for a predetermined period of time, the second amount of silicon material being based, at least in part, on the first amount of silicon material present in the hydrocarbon feed that is to be steam cracked;

introducing a sufficient amount of one or more catalysts into a hydroprocessing unit to allow the hydroprocessing unit to hydroprocess the steam cracker naphtha that is to be separated from the steam cracker effluent for at least as long as the predetermined period of time without requiring replacement or re-activation of the one or more catalysts due to catalyst deactivation caused by the silicon material present in the steam cracker naphtha; and steam cracking the hydrocarbon feed to produce the steam cracker effluent.

2. The process of claim 1, wherein the second amount of silicon material that will be present in the steam cracker naphtha is 5% to about 75% of the first amount of silicon material present in the hydrocarbon feed that is to be steam cracked.

3. The process of claim 2, wherein the second amount of silicon material that will be present in the steam cracker naphtha is about 15% to about 52.5% of the first amount of silicon material present in the hydrocarbon feed that is to be steam cracked.

4. The process of claim 1, wherein the first amount of silicon material present in the hydrocarbon that is to be steam cracked is determined by one or more measurements using one or more of an atomic emission detector, an x-ray fluorescence spectrometer, and an inductively coupled plasma-mass spectrometer.

5. The process of claim 1, wherein the silicon material in the steam cracker naphtha comprises≤1 wt. % of $C_5$-$C_6$ silicones and about 10 wt. % to about 50 wt. % of $C_7$-$C_9$ silicones, based on the weight of the silicon material in the steam cracker naphtha.

6. The process of claim 1, wherein the silicon material that is present in the hydrocarbon feed that is to be steam cracked comprises sand, dirt, quartz, glass, lava, pumice, polysiloxanes, water soluble hydrophilic silicones, or a mixture thereof, and wherein the one or more catalysts comprises a nickel sulfide catalyst, a nickel molybdenum catalyst, a cobalt molybdenum catalyst, or a mixture thereof.

7. The process of claim 1, wherein the first amount of silicon material present in the hydrocarbon feed that is to be steam cracked is about 0.1 weight parts per million to about 25 weight parts per million based on a weight of the hydrocarbon feed that is to be steam cracked.

8. The process of claim 1, wherein the hydroprocessing unit comprises a first hydroprocessor that includes a first catalyst disposed therein and a second hydroprocessor that includes a second catalyst disposed therein, and wherein an amount of the first catalyst that is introduced into the first hydroprocessor is less than an amount of the second catalyst that is introduced into the second hydroprocessor.

9. The process of claim 8, wherein the hydroprocessing unit comprises a first hydroprocessor that includes a first catalyst disposed therein and a second hydroprocessor that includes a second catalyst disposed therein, and wherein an amount of the first catalyst that is introduced into the first hydroprocessor is greater than an amount of the second catalyst that is introduced into the second hydroprocessor.

10. The process of claim 9, wherein the predetermined period of time is based, at least in part, on a desired volume of the hydrocarbon feed that is to be steam cracked during the predetermined period of time.

11. A process for upgrading a hydrocarbon for a predetermined period of time, comprising:

measuring a first amount of silicon material in a hydrocarbon feed that is to be steam cracked in a steam cracker to produce a steam cracker effluent;

determining a second amount of silicon material that will be present in a steam cracker naphtha that is to be separated from the steam cracker effluent based, at least in part, on the first amount of silicon material present in the hydrocarbon feed that is to be steam cracked;

introducing a sufficient amount of one or more catalysts into a hydroprocessing unit to allow the hydroprocessing unit to hydroprocess the steam cracker naphtha that is to be separated from the steam cracker effluent for at least as long as a predetermined period of time without requiring replacement or re-activation of the one or more catalysts due to catalyst deactivation caused by the silicon material present in the steam cracker naphtha;

heating a mixture comprising the hydrocarbon feed that is to be steam cracked and water, steam, or a mixture of water and steam to produce a heated mixture comprising steam and the hydrocarbon feed that is to be steam cracked;

separating a vapor phase product and a liquid phase product from the heated mixture comprising steam and the hydrocarbon feed that is to be steam cracked;

steam cracking the vapor phase product to produce a steam cracker effluent;

separating the steam cracker naphtha and a process gas comprising ethylene and propylene from the steam cracker effluent; and hydroprocessing the steam cracker naphtha for at least as long as the predetermined period of time.

12. The process of claim 11, wherein the one or more catalysts comprises a nickel sulfide catalyst, a nickel molybdenum catalyst, a cobalt molybdenum catalyst, or a mixture thereof.

13. The process of claim 11, wherein the second amount of silicon material that will be present in the steam cracker naphtha is about 5% to about 75% of the first amount of material comprising silicon present in the hydrocarbon feed that is to be steam cracked.

14. The process of claim 11, wherein the second amount of silicon material that will be present in the steam cracker naphtha is about 15% to about 52.5% of the first amount of silicon material present in the hydrocarbon feed that is to be steam cracked.

15. The process of claim 11, wherein the first amount of silicon material present in the hydrocarbon feed that is to be steam cracked is about 0.1 weight parts per million to about 25 weight parts per million based on a weight of the hydrocarbon feed that is to be steam cracked, and wherein the second amount of silicon material that will be present in the steam cracker naphtha is about 0.015 weight parts per million to about 13.125 weight parts per million.

16. The process of claim 11, wherein the silicon material in the steam cracker naphtha comprises≤1 wt. % of $C_5$-$C_6$ silicones and about 10 wt. % to about 50 wt. % of $C_7$-$C_9$ silicones, based on the weight of the silicon material in the steam cracker naphtha.

17. The process of claim 11, wherein:

the hydroprocessing unit comprises a first hydroprocessor that includes a first catalyst disposed therein and a second hydroprocessor that includes a second catalyst disposed therein, the first hydroprocessor converts diolefins in the steam cracker naphtha to monoolefins to produce a first hydroprocessed naphtha, the second hydroprocessor converts olefins in the first hydroprocessed naphtha to paraffins and converts sulfur compounds in the first hydroprocessed naphtha to hydrogen sulfide to produce a second hydroprocessed naphtha, and an amount of the first catalyst that is introduced into the first hydroprocessor is less than an amount of the second catalyst that is introduced into the second hydroprocessor.

18. The process of claim 11, wherein:

the hydroprocessing unit comprises a first hydroprocessor that includes a first catalyst disposed therein and a second hydroprocessor that includes a second catalyst disposed therein, the first hydroprocessor converts diolefins in the steam cracker naphtha to monoolefins to produce a first hydroprocessed naphtha, the second hydroprocessor converts olefins in the first hydroprocessed naphtha to paraffins and converts sulfur compounds in the first hydroprocessed naphtha to hydrogen sulfide to produce a second hydroprocessed naphtha, and an amount of the first catalyst that is introduced into the first hydroprocessor is greater than an amount of the second catalyst that is introduced into the second hydroprocessor.

19. The process of claim 11, wherein the hydrocarbon feed that is to be steam cracked comprises naphtha, gas oil, vacuum gas oil, a waxy residue, an atmospheric residue, a crude oil, or a mixture thereof.

20. The process of claim 11, wherein the steam cracker naphtha comprises a mixture of $C_5$ to $C_{10+}$ hydrocarbons and has an initial boiling point at atmospheric pressure of about 25° C. to about 50° C. and a final boiling point at atmospheric pressure of about 220° C. to about 265° C., as measured according to ASTM D2887-18.

21. A process for configuring a system, the system comprising:

a steam cracker configured to indirectly heat a mixture comprising steam and a hydrocarbon feed to produce a heated mixture and to steam crack a vapor phase product separated from the heated mixture to produce a steam cracker effluent;

a first separator configured to separate the vapor phase product and a liquid phase product from the heated mixture;

a second separator configured to separate a steam cracker naphtha and a process gas comprising ethylene and propylene from the steam cracker effluent; and a hydroprocessing unit comprising one or more catalysts disposed therein and configured to hydroprocess the steam cracker naphtha in the presence of the one or more catalysts and molecular hydrogen, the process comprising:

measuring a first amount of silicon material present in the hydrocarbon feed;

determining a second amount of silicon material that will be present in the steam cracker naphtha that is to be separated from the steam cracker effluent based, at least in part, on the first amount of silicon material present in the hydrocarbon feed;

determining the amount of the one or more catalysts that should be disposed in the hydroprocessing unit based, at least in part, on the second amount of silicon material that will be present in the steam cracker naphtha that is to be separated from the steam cracker effluent;

ensuring a sufficient amount of the one or more catalysts is disposed within the hydroprocessing unit to allow the hydroprocessing unit to hydroprocess the steam cracker naphtha that is to be separated from the steam cracker effluent for at least as long as a predetermined period of time without requiring replacement or re-activation of the one or more catalysts due to catalyst deactivation caused by the silicon material present in the steam cracker naphtha;

indirectly heating the mixture comprising steam and the hydrocarbon feed in the steam cracker to produce the heated mixture;

introducing the heated mixture into the first separator to separate the vapor phase product and the liquid phase product;

steam cracking the vapor phase product in the steam cracker to produce the steam cracker effluent;

separating the steam cracker naphtha and the process gas from the steam cracker effluent with the second separator; and hydroprocessing the steam cracker naphtha in the hydroprocessing unit for at least as long as a predetermined period of time without requiring replacement or re-activation of the one or more catalysts due to catalyst deactivation caused by the silicon material present in the steam cracker naphtha.

22. The process of claim 21, wherein the hydroprocessing unit comprises a first hydroprocessor comprising a first catalyst disposed therein, and a second hydroprocessor comprising a second catalyst disposed therein, wherein the first hydroprocessor is configured to convert diolefins in the steam cracker naphtha to monoolefins in the presence of molecular hydrogen and the first catalyst to produce a first hydroprocessed naphtha, and wherein the second hydroprocessor is configured to convert olefins to paraffins and sulfur compounds to hydrogen sulfide in the first hydroprocessed naphtha in the presence of molecular hydrogen and the second catalyst to produce a second hydroprocessed naphtha.

23. The process of claim 22, wherein the first catalyst comprises a nickel sulfide catalyst, and wherein the second catalyst comprises a nickel molybdenum catalyst, a cobalt molybdenum catalyst, or a mixture thereof.

24. The of claim 21, further comprising measuring the first amount of silicon material present in the hydrocarbon feed with an atomic emission detector, an x-ray fluorescence spectrometer, an inductively coupled plasma-mass spectrometer, or a combination thereof.

25. A process for upgrading a hydrocarbon for a predetermined period of time, comprising:

measuring a first amount of silicon material in a hydrocarbon feed that is to be steam cracked in a steam cracker to produce a steam cracker effluent, wherein the hydrocarbon feed comprises naphtha, gas oil, vacuum gas oil, a waxy residue, an atmospheric residue, a crude oil, or a mixture thereof;

determining a second amount of silicon material that will be present in a steam cracker naphtha that is to be separated from the steam cracker effluent based, at least in part, on the first amount of silicon material present in the hydrocarbon feed that is to be steam cracked;

introducing a sufficient amount of one or more first catalysts into a first hydroprocessing unit to allow the first hydroprocessing unit to hydroprocess the steam cracker naphtha that is to be separated from the steam cracker effluent for at least as long as a predetermined period of time without requiring replacement or re-activation of the one or more first catalysts due to catalyst deactivation caused by the silicon material present in the steam cracker naphtha; and introducing a sufficient amount of one or more second catalysts into a second hydroprocessing unit to allow the second hydroprocessing unit to hydroprocess a pretreated steam cracker naphtha that is to be recovered from the first hydroprocessing unit for at least as long as a predetermined period of time without requiring replacement or re-activation of the one or more second catalysts due to catalyst deactivation caused by the silicon material present in the steam cracker naphtha.

26. The process of claim 25, further comprising:

heating a mixture comprising the hydrocarbon feed that is to be steam cracked and water, steam, or a mixture of water and steam to produce a heated mixture comprising steam and the hydrocarbon feed;

separating a vapor phase product and a liquid phase product from the heated mixture comprising steam and the hydrocarbon feed;

steam cracking the vapor phase product to produce a steam cracker effluent;

separating the steam cracker naphtha and a process gas comprising ethylene and propylene from the steam cracker effluent, wherein the silicon material in the steam cracker naphtha comprises≤1 wt. % of $C_5$-$C_6$ silicones and about 10 wt. % to about 50 wt. % of $C_7$-$C_9$ silicones, based on the weight of the silicon material in the steam cracker naphtha;

hydroprocessing the steam cracker naphtha for at least as long as the predetermined period of time in the first hydroprocessing unit to produce the pretreated steam cracker naphtha; and hydroprocessing the pretreated steam cracker naphtha for at least as long as the predetermined period of time in the second hydroprocessing unit to produce a hydroprocessed steam cracker naphtha.

* * * * *